United States Patent [19]

Giannotti

[11] Patent Number: 4,699,114

[45] Date of Patent: Oct. 13, 1987

[54] BALLISTIC PARTICLE SEPARATOR

[76] Inventor: Hugo V. Giannotti, 879 S. Country Rd., E. Patchogue, N.Y. 11772

[21] Appl. No.: 715,204

[22] Filed: Mar. 25, 1985

Related U.S. Application Data

[63] Continuation of Ser. No. 387,352, Jun. 11, 1982, Pat. No. 4,524,748.

[51] Int. Cl.[4] ..... F02M 33/02

[52] U.S. Cl. ..... 123/591; 55/376

[58] Field of Search ..... 123/591; 55/396, 391, 55/392

[56] References Cited

U.S. PATENT DOCUMENTS 3,283,480 11/1966 Szego ..... 55/392

3,884,660 5/1975 Perry, Jr. et al. ..... 55/397

3,925,045 12/1975 Cheng ..... 55/397

3,944,399 3/1976 Gspann ..... 55/392

*Primary Examiner*—E. Rollins Cross

[57] ABSTRACT

A device for the physical separation of particles from a gas stream consisting of a two-dimensional flow unit in which the flow is accelerated to the throat and then diffused so that the particles are inertially urged to the core and to the trap. It is unique in that a telescope two-stage nozzle-diffuser arrangement is used to obtain a compact, low pressure loss unit. The design is such that all inertal forces including the Magnus force within the boundary layer act in the direction of particle separation towards the core and a sharp particle size cutoff is obtained down to 2 micron.

2 Claims, 4 Drawing Figures

Fig. 1.
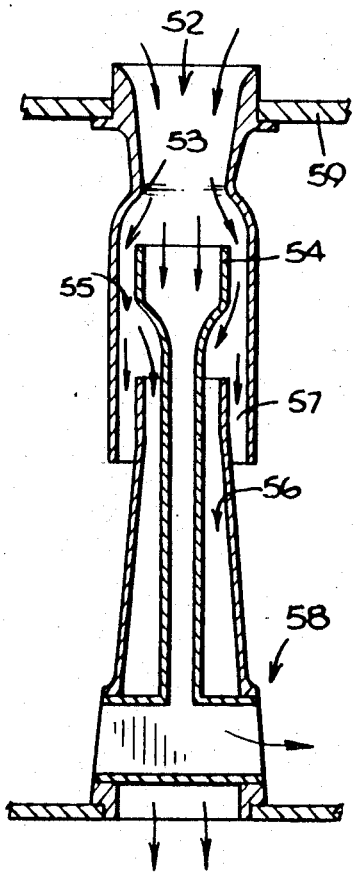
Fig. 3.
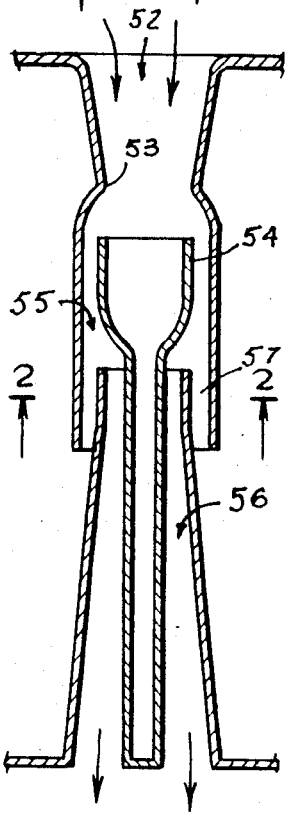
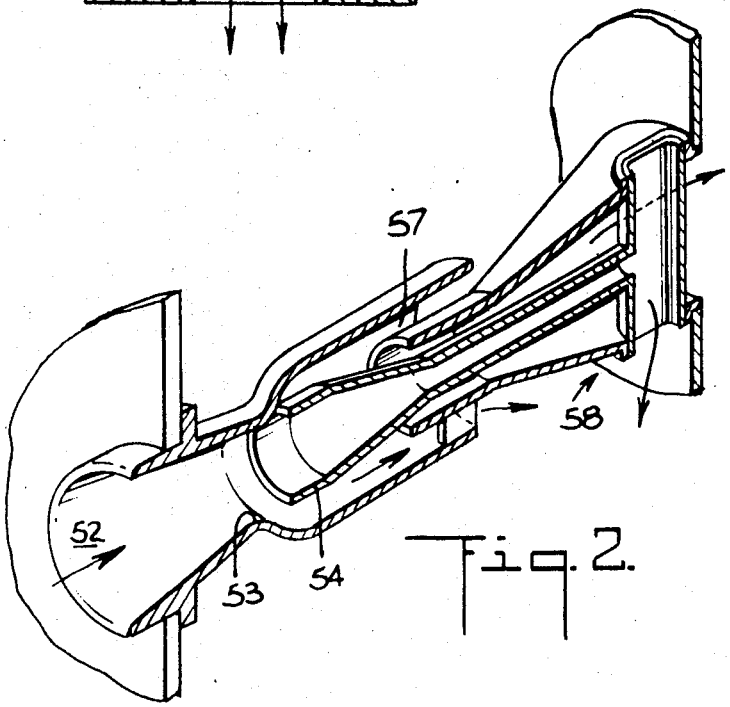
Fig. 2.
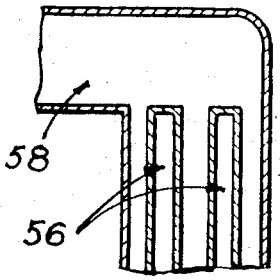
Fig. 4.

BALLISTIC PARTICLE SEPARATOR

This application is a continuation of application Ser. No. 06/387,352 filed 6/11/82 now U.S. Pat. No. 4,524,748.

This invention relates to a device for separating a substance of a greater density from another substance, and more particularly to a device for separating solid particles from a flow of gas.

Devices for separating substances of different densities in response to inertia forces have commonly been of the centrifugal or cyclone-type of separator. Cyclone separators remove solid particles such as dust from a flow of air or other gas by subjecting the flow to a spiral-like motion during which centrifugal force urges the denser particles to move outward with respect to the gas in which they are suspended. Openings adjacent the outer portion of the cyclone separator remove the outer portion of the flow into which the denser particles have been concentrated. Because of the necessity of forcing the flow through a spiral path, cyclone separators are devices which inherently require a large space envelope and consequently they frequently penalize applications where space or weight is a prime consideration.

Equipment such as internal combustion engines must be operated with a flow of air that is relatively free from dust and other solid particles. In reciprocating engines, dust can become deposited in the lubricating oil and cause rapid wear. The passage of dust through gas turbine engines can erode the blades. In addition, the long and tortuous flow paths through cyclone generators can result in a substantial pressure drop across the separator which results in a power loss in the internal combustion engine connected to the separator. This is especially true in the case of gas turbine engines in which the performance is radically affected by changes in pressure and temperature at the air inlet to the engine.

It is an object of the invention to provide a device which can separate a substance of greater density from the flow of another substance and which is comparatively compact in relation to the quantity of flow of the substances through the device.

Another object of the invention is to provide a device for separating a substance of greater density from the flow of another substance with the minimum of pressure drop occurring during the flow of the substances through the device.

A further object of the invention is to provide a relatively compact device for separating dust particles from a flow of air flow with a minimum of pressure drop across the separating device.

In the embodiment of the invention, the device for separating the particles consists of concentric tubular or rectangular members which cause the main air flow to modulate and separate from the particles which are scavenged out together with a small amount of scavenge air.

Other objects and advantages will become apparent from the following description taken in connection with the accompanying drawings in which:

FIG. 1 is a vertical section through another embosiment of the invention showing one of the array of concentric tubes consisting of a particle trap leading to the scavenge outlet and a second particle trap to the same scavenge outlet.

FIG. 2 is a perspective view of the element of FIG. 1.

FIG. 3 is a vertical section through another embodiment of the invention showing the separator element contour of FIG. 1 in which the portions forming the trap and diffuser are substantially rectangular, rather than tubular.

FIG. 4 is an elevational view taken on line 2—2 of FIG. 3 showing the outlet of the substantially rectangular arrangement of FIG. 3.

Referring to FIG. 1 the particle-laden gas enters the separator and particles are quickly accelerated at the inlet section 52 to almost air velocity. Particle inertia of the larger particles causes them to leave the streamline at the throat 53 and enter the trap 54. The main or primary air flow travels through passages 55 and 56. Additional oversize particles are separated in the air streamline undulation between 55 and 56, these particles entering trap 57 which leads to a common manifold 58 with trap 54 and from there the particles are scavenged out. The test data on this concentric geometry have shown that practically 100% of all particles above a size as low as about 2 micron can be efficiently removed.

Another version of the element geometry of FIG. 1 is shown in FIG. 3 wherein the passages are rectangular in cross section, as shown by FIG. 4, rather than tubular.

What is claimed is:

1. A particle separator comprising, in combination, a housing having an inlet and an outlet arranged for flow therethrough of air carrying particles of different weights; and, disposed in the housing across the line of air flow from the inlet to the outlet, an array of elements each having a tubular body of converging-diverging shape, the minimum through passage of which defines a throat, the said tubular body having an outlet adapted to be connected to a manifold; a tubular particle trap disposed substantially along the longitudinal axis of said tubular body and downstream of said throat leading to the manifold, said trap converging to a smaller diameter; a tubular member surrounding outside of said trap, the inlet of said surrounding tubular member being disposed downstream of the point where said trap starts to converge, thereby forming two annuli, the first annulus formed between said tubular member and said trap, causing the main airstream to make a relatively sharp turn into the first annulus thereby depositing heavier particles to the outer second annulus formed by said tubular body and said member, the outlet of the second annulus communicating with the manifold.

2. A particle separator in accordance with claim 1 in which said tubular body, said tubular particle trap and said tubular member have substantially rectangular cross-sections perpendicular to the direction of air flow.

* * * * *